US005168842A

United States Patent [19]

Brooks

[11] Patent Number: 5,168,842

[45] Date of Patent: Dec. 8, 1992

[54] SPARK PLUG WIRING HARNESS ASSEMBLY

[76] Inventor: Steve Brooks, 1790 Fox Run Rd., Reno, Nev. 89523

[21] Appl. No.: 826,529

[22] Filed: Jan. 27, 1992

[51] Int. Cl.[5] ..... F02P 15/00

[52] U.S. Cl. ..... 123/143 C; 174/72 A

[58] Field of Search ..... 123/143 C, 169 PA; 174/72 A

[56] References Cited

U.S. PATENT DOCUMENTS

| | | | |
|---|---|---|---|
| 2,343,314 | 3/1944 | Miller et al. | 123/606 |
| 2,997,531 | 8/1961 | Oldham et al. | 174/72 A X |
| 3,342,168 | 9/1967 | Burdette | 123/169 PA |
| 3,920,887 | 11/1975 | Kloos et al. | 174/148 |
| 3,923,277 | 12/1975 | Perrault et al. | 248/49 |
| 4,366,939 | 1/1983 | McMillan | 248/68.1 |
| 4,771,743 | 9/1988 | McDowell | 123/143 C |
| 4,957,251 | 9/1990 | Hubbard | 248/68.1 |

OTHER PUBLICATIONS

High-Tech Acessories P/N 1637, Spectre Performance Products, 1990-1991 Catalog, p. 21.

Spectre TM Catalog 1991, P/N 1637, 2 pages.

R & M Specialties, 2 pages (3 and 4), 1991 Catalog, Back Cover.

Smoothe Separators 1991, Maid for Your Products, 1991 Catalog, p. 3.

MSD Ignition, 4 pages 1992-1993 Catalog, pp. 53-54.

Mallory Ignition, 2 pages (31,32) 1991 Catalog.

Hartman Enterprises, Catalog 11, Oct. 1991, p. 4.

Taylor Wire Separators, p. 4, 1991 Catalog.

*Primary Examiner*—Tony M. Argenbright

*Attorney, Agent, or Firm*—Dowell & Dowell

[57] ABSTRACT

A spark plug wire harness which includes a plurality of brackets having base portions which are secured to the valve cover of conventional internal combustion engines utilizing existing bolts and which have longitudinally and vertically aligned openings through which the spark plug wires are retained to thereby both space the wires from the engine and each other and to organize and align the wires between the distributor and the spark plugs. In some embodiments the brackets include adjustable sections.

20 Claims, 3 Drawing Sheets

SPARK PLUG WIRING HARNESS ASSEMBLY

BACKGROUND OF THE INVENTION

1. Field of the Invention

This invention is generally directed to supports or harnesses for retaining electrical wires or cables in orderly relationship and, more specifically, to wiring harnesses for use with conventional internal combustion engines for supporting spark plug wires extending between an engine's distributor and the spark plugs. The wiring harnesses of the invention are structured so as to positively and orderly maintain the spark plug wires in spaced relationship with respect to the engine block and each other to thereby reduce the damaging effect to the wiring insulation due to heat dissipated from the engine and to prevent electrical arcing or shorting between adjacent spark plug wires. The wiring harnesses of the present invention may also be secured to engines utilizing existing bolts so that no modifications are required to engine blocks or other components.

2. History of the Related Art

The use of harnesses for organizing electrical wiring is well known in many industries. In most instances, such wiring harnesses are utilized to securely maintain wires within a fixed bundle so that the wires are not accidently displaced or accidently damaged, thereby interrupting an electrical circuit. However, harnesses also are utilized to facilitate identification of electrical wires by retaining the wires in an orderly relationship with respect to one another along any given electrical system.

In the automotive industry, wiring harnesses have been utilized to organize and support the electrical spark plug wires which extend from an engine's distributor to the spark plugs associated with the combustion chambers of the engine. In U.S. Pat. No. 2,997,531 to Oldham et al., an insulating support for the spark plug ignition wires is disclosed which incorporates a bracket which is mounted to the valve cover and to which a clip is selectively attached. The clip member includes a plurality of slots in which the spark plug wires ma be selectively frictionally received. The supports were designed to reduce the capacitance between the spark plug wires and the engine components to a minimum. Unfortunately, such a mounting arrangement requires that modifications be made to the valve cover by way of separate mounting attachments to secure the brackets of the insulated supports to engine valve covers. Further, the supports are not designed to provide efficient spacing between the spark plugs and the hot spots of an internal combustion engine and thus do not effectively reduce potential damage to the insulated coverings of the spark plug wires. After numerous hours of engine operation, spark plug wires will begin to deteriorate causing cracks in the insulated walls or coverings of the wiring resulting in the potential for electrical arcing between the conductors of the spark plug wires and adjacent metallic components or adjacent electrical wires. A further problem associated with such wire supports is that the spark plug wires are only frictionally retained by the brackets and therefore can be easily displaced during routine engine maintenance or by vibrations caused by normal engine operation.

In U.S. Pat. No. 3,342,168 to Burdette, another spark plug wire harness system is disclosed which was specifically designed to decrease inductive losses through the spark plug wires by way of arcing between the conductors of one wire relative to another or from the conductors of a wire relative to the engine. The system utilizes spark plug wires of essentially the same length which are mounted by both fixed brackets which are secured to various components of the engine, such as the air filter or valve cover, and floating brackets which are utilized to retain the spark plug wires in spaced relationship with respect to one another between the fixed brackets. Although the wiring harness of this patent does provide brackets for mounting the spark plug wires in spaced relationship from the hot spots of the engine, the fixed brackets and the floating brackets are designed to frictionally receive the spark plug wires within slots provided in each member. As with other such harnesses, the electrical wires may be accidently displaced from within slots in which they are frictionally engaged either during routine maintenance or by the result of normal engine vibration, thereby allowing the wires to make contact with hot spots of the engine which can result in deterioration of the insulating covering or jacket of the spark plug wires. Further, the harness system requires that modification be made to existing engine components such as by providing mounting bolts which are utilized to secure the fixed brackets to the air cleaner or to other engine components. Due to the different configurations or paths which spark plug wires must follow in each internal combustion engine, in order to properly install such a harness system, an individual must make modifications to the equipment to properly align each of the brackets before the brackets ar secured to the engine components.

An additional example of a spark plug wire retainer which utilizes grooved supports for the electrical wiring is disclosed in U.S. Pat. No. 4,771,743 to McDowell. As with the harness systems discussed above, such a system does not provide for a secure retention of the spark plug wires, especially in an environment where the wires are subjected to constant engine vibration which can work to dislodge the spark plug cables from the supporting brackets.

Other prior art examples of wiring harnesses are disclosed in U.S. Pat. No. 2,343,314 to Miller et al., U.S. Pat. No. 3,920,887 to Kloos et al., and U.S. Pat. No. 4,366,939 to McMillan.

SUMMARY OF THE INVENTION

The present invention is directed to a wiring harness assembly for securely supporting spark plug wires associated with an internal combustion engine between the distributor and the spark plugs and which includes at least one set of first and second bracket members having base portions which are configured so as to be readily secured to the engine valve cover utilizing existing valve cover bolts. In the preferred embodiment, each base portion includes an outwardly extending flange having an opening therethrough through which the valve cover bolts are selectively received. The first and second bracket members also include vertical extensions through which the spark plug wires are selectively received and positively retained. The first bracket member includes a pair of spaced vertical extensions wherein the first vertical extension has a first number of openings therethrough through which a first number of spark plug wires are extended and wherein the second vertical extension includes a second number of openings therethrough through which a second number of spark plug wires are extended from said first vertical extension. The base portion of the first bracket member includes a number of wire receiving openings for positively retaining two or more of the first number of spark plug wires extending to the spark plugs. The second bracket member includes at least one vertical extension having a number of openings equal to the number of openings in said second vertical extension of the first bracket member and further includes the same number of wire receiving openings through the base portion thereof so that the spark plug wires extending through said second vertical extension of said first bracket member also extend through the vertical extension of the second bracket member and through the openings in the base portion thereof to the spark plugs.

In one embodiment of the present invention, the base portions of either or both the first and second bracket members may include first and second sections which are selectively alignable with respect to one another so as to thereby adjust the positioning of the mounting flange associated with the bracket member to thereby facilitate the selective positioning of the bracket members relative to the valve cover of an engine. The sections are selectively secured to one another by conventional fastening elements.

In another embodiment of the present invention, a third bracket member is provided intermediate the distributor and the first vertical extension of the first bracket member. The third bracket member includes a body portion having a number of openings therethrough equal to the number of openings in the first vertical extension of the first bracket member and may include a base portion which is selectively secured to the engine by conventional mounting means.

It is a primary object of the present invention to provide a wiring harness system for supporting the spark plug wires associated with an internal combustion engine in orderly and spaced relationship with respect to one another between the engine's distributor and spark plugs and wherein the wires are retained in spaced relationship from the engine components to thereby reduce the possibility of heat damage to the insulating cover of the spark plug wires and wherein the wires are also spaced relative to one another to prevent arcing between the wires during engine operation.

It is yet another object of the present invention to provide a wiring harness system for supporting the spark plug wires associated with an internal combustion engine wherein the brackets are designed to be mounted to the valve cover of the engine utilizing existing valve cover mounting bolts so that additional fastening elements and engine modifications are not necessary in order to mount the harness system to the engine.

It is also an object of the present invention to provide a spark plug wire harness system for use with conventional internal combustion engines wherein the wires are positively retained through openings provided in the support brackets associated with the harness system so that the wires may not be accidently dislodged from the brackets by engine vibration.

It is also an object of the present invention to provide a wiring harness system for use in supporting spark plug wires between the distributor and spark plugs of an internal combustion engine wherein the bracket members include mounting portions which are selectively adjustable with respect to one another to thereby allow the brackets to be adapted for attachment to different types of engines without requiring modification to the engine components.

DESCRIPTION OF THE PREFERRED EMBODIMENT

Figure 1:
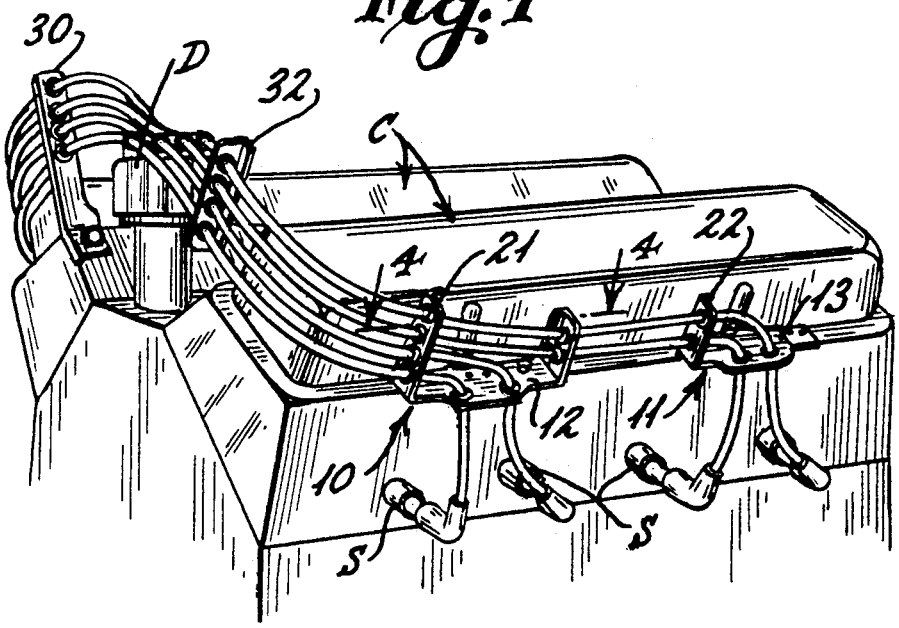
FIG. 1 is a perspective illustrational view of one embodiment of a wiring harness system in accordance with the teachings of the present invention showing four different types of brackets which may be utilized to support the spark plugs wires between a distributor and the spark plugs associated with a conventional eight cylinder internal combustion engine.
Figure 3:
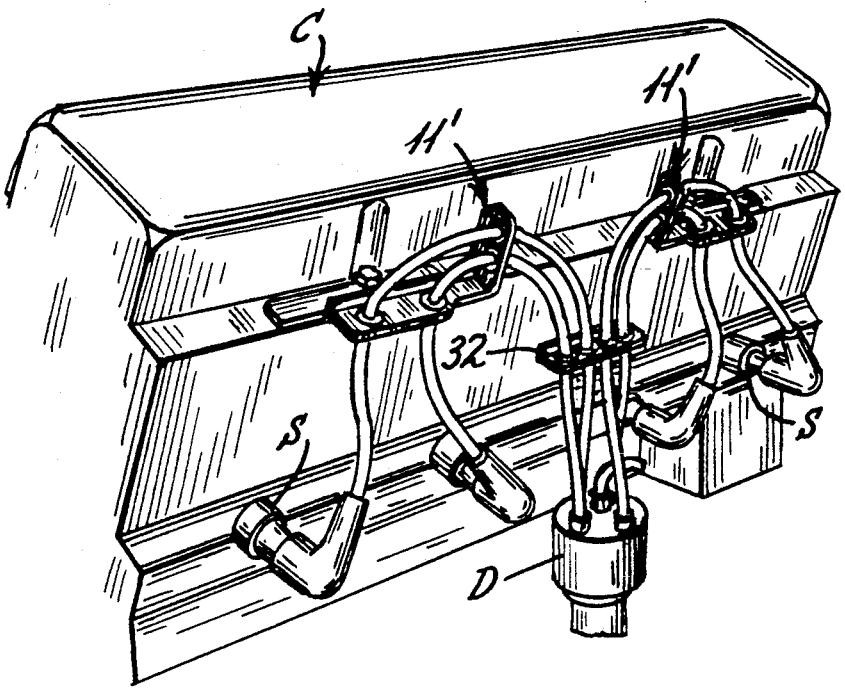
FIG. 3 is a perspective illustrational view of a wiring harness system using the fixed or non-adjustable brackets of the present invention utilized in association with a four cylinder engine.

With continued reference to the drawings, the spark plug wiring harness system of the present invention will be described relative to installation with an eight cylinder engine, as shown in FIG. 1, and a four cylinder engine, shown in FIG. 3. It should be emphasized, however, that the wiring harness system of the present invention may be utilized with essentially any internal combustion engine regardless of the number of cylinders and therefore regardless of the number of spark plug wires associated with such engines. The wiring harness systems are utilized to support the spark plug wires W between the engine's distributor D in drawing FIGS. 1 and 3, and the engine spark plugs in FIGS. 1 and 3. The mounting brackets of the present invention are further designed to be cooperatively engaged with the valve covers C of conventional internal combustion engines by way of existing mounting bolts B which are utilized to secure the valve covers to the engine blocks.

Figure 4:
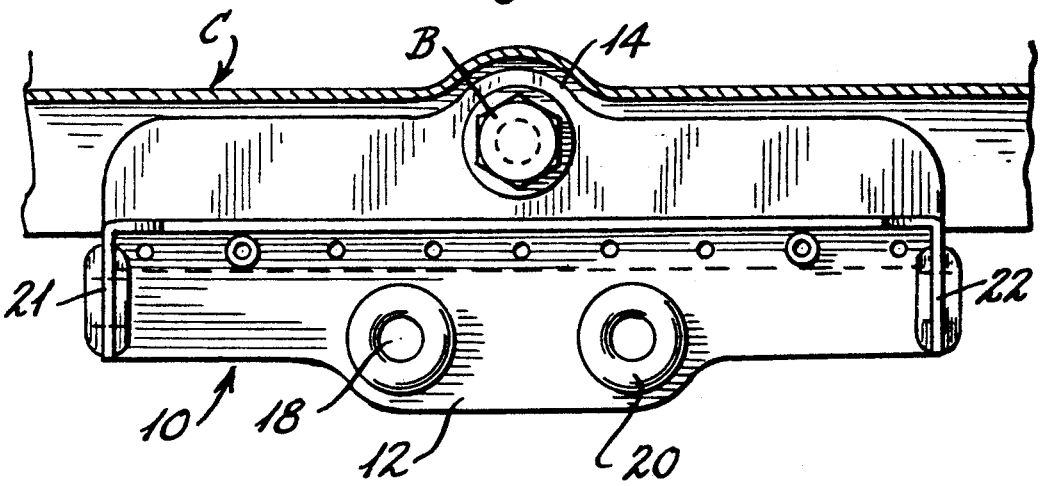
FIG. 4 is an enlarged top plan view of adjustable supporting brackets utilized in the wiring harness system of the present invention as shown in FIG. 1 secured by a conventional valve cover bolt to the valve cover of an internal combustion engine.
Figure 6:
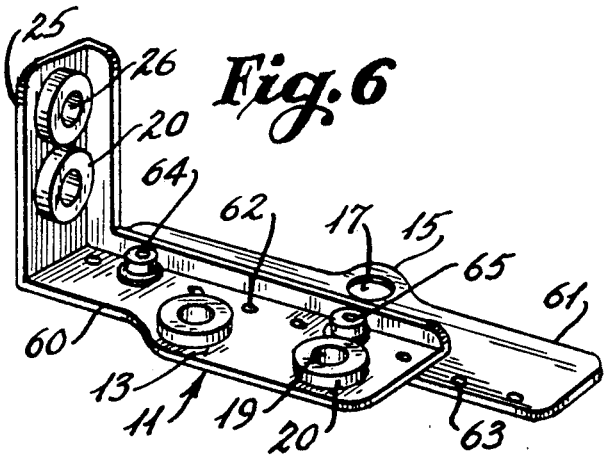
FIG. 6 is a perspective view of a second type of adjustable bracket utilized with the wiring harness system of the present invention.
Figure 7:
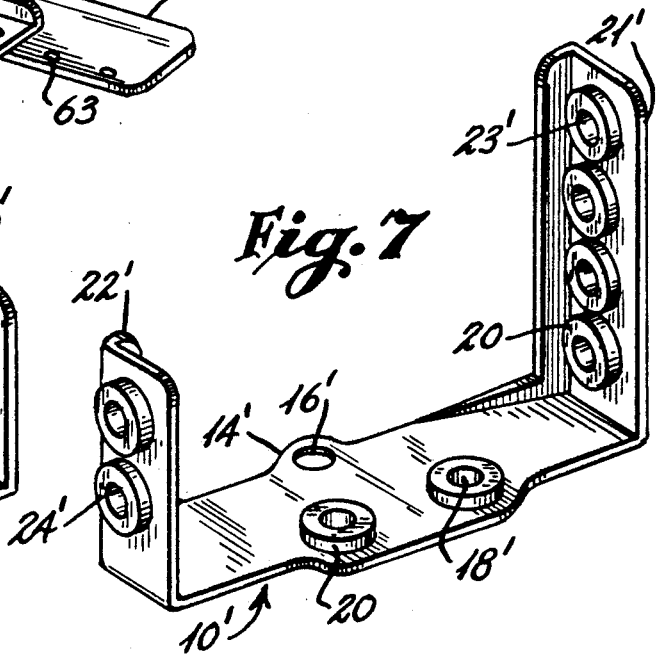
FIG. 7 is a perspective view of a nonadjustable mounting bracket utilized with the wiring harness system of the present invention as shown in FIG. 2.

With specific reference to FIG. 1, the wiring harness system of the present invention includes first and second spaced bracket members 10 and 11 which are designed to be mounted directly to the engine valve cover C by way of the mounting bolts B, conventionally associated with the valve covers. In an eight cylinder engine, two sets of mounting brackets 10 and 11 are required. The mounting brackets 10 and 11 may be adjustable as shown in FIG. 1 and also in FIGS. 4–6, or, may be non-adjustable as shown at 10' and 11' in FIGS. 2 and 3, and also in FIGS. 7 and 8, as will be discussed in greater detail hereinafter. FIG. 3 shows the non-adjustable brackets used with a four cylinder engine, it being noted that the adjustable brackets 11 could be used.

Each of the brackets 10 and 11, and 10' and 11' includes a base portion 12 and 13 and 12' and 13', respectively. Each base portion further includes an outwardly extending flange element 14 and 15 and 14' and 15', respectively, each having a first opening therethrough for selectively receiving one of the valve cover mounting bolts B for purposes of securing the brackets to the valve cover C of the engine. The first openings are designated in the drawing figures for the mounting brackets 10 and 11, and 10' and 11' as being 16 and 17 and 16' and 17', respectively. Each base portion further includes a second pair of wire receiving openings 18 and 19 and 18' and 19' through which the spark plug wires S are selectively extended. It should be noted that the second pair of openings are completely inset within the bracket bases so that the wires may not be separated from the bases except by being displaced axially by sliding through the openings. In this manner, the wires may not be separated from the brackets by engine vibration. In the drawing figures each of the openings 18 and 19 and 18' and 19' include grommets 20 having an internal diameter of a size to frictionally engage the insulated coverings of the spark plug wires. The grommets are preferably made of a rubber or plastic type material. It should be noted that the flanges 14 and 15 and 14' and 15' are generally designed to allow the base portions of the brackets 10 and 11 and 10' and 11' to be selectively received within the conventional recesses which are normally found in valve covers adjacent the valve cover mounting bolts, as is shown in FIGS. 1–4 of the drawing figures.

Each of the first mounting brackets 10 and 10' include a pair of spaced vertically oriented or outward extensions 21 and 22 and 21' and 22' which are disposed on opposite sides of the openings through the base portions of the brackets. In use, the extensions 21 and 21' are oriented toward the distributor D so that the spark plug wires coming from the distributor pass through a plurality of vertically spaced openings 23 and 23' disposed therethrough. As with the openings in the base portion for the spark plug wires, the openings 23 and 23' are provided with grommets 20 having inner diameters for frictionally engaging the outer surface of the spark plug wires. In the embodiment shown in the present drawing figures, there are four openings 23 and 23' through the first vertical extensions. In some instances, the number of openings may vary depending upon the cylinder arrangement of the internal combustion engine.

Figure 2:
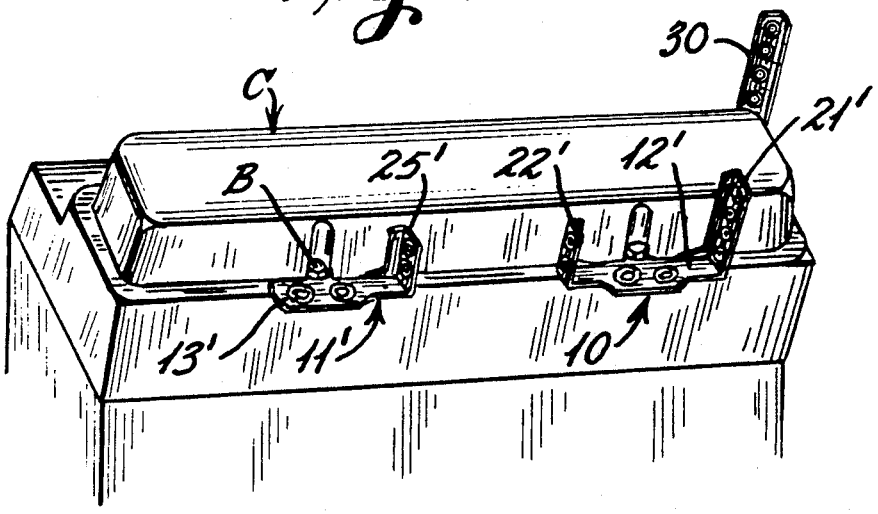
FIG. 2 is a perspective view of the back side of the engine block of FIG. 1 showing a second embodiment of the brackets of the present invention mounted thereto.

With specific reference to FIGS. 1 and 2, it should be noted that the spark plug wires W extending through the openings 23 and 23' are separated such that a first pair of the wires extend downwardly through the openings 18 and 18' in the base portion of the brackets 10 and 10' and are directed therethrough vertically to the first two spark plugs. In addition, the upper pair of spark plug wires extend horizontally across the bracket and through a pair of openings 24 and 24' which are in vertically spaced relationship through the second vertical extensions 22 and 22'. The openings 24 and 24' are also provided with grommets 20 for frictionally engaging the spark plug wires extending therethrough.

Each of the second mounting brackets 11 and 11' include a single vertical extension 25 and 25' having the same number of openings designated at 26 and 26' therethrough which are equal to the openings 24 and 24' in the vertical extensions 22 and 22' of the brackets 10 and 10'. Again, the openings 26 and 26' are protected by grommets 20 of a size to frictionally engage the spark plug wires extending therethrough. The wires extending through the vertical extensions 25 and 25' are thereafter directed through the openings 19 and 19' to the spark plugs vertically spaced there below.

Figure 9:
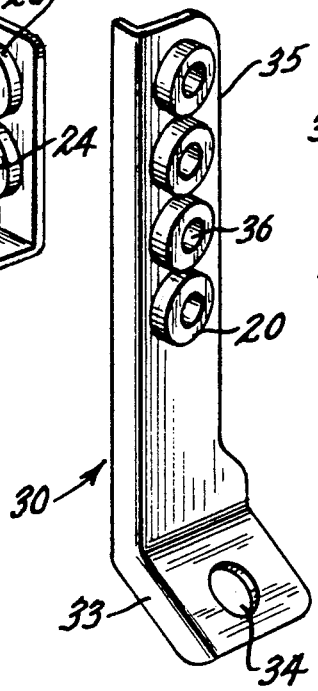
FIG. 9 is a perspective view of a third type of nonadjustable bracket utilized with the wiring harness system of the present invention and designed to be mounted to an engine using the rear intake manifold bolt.
Figure 10:
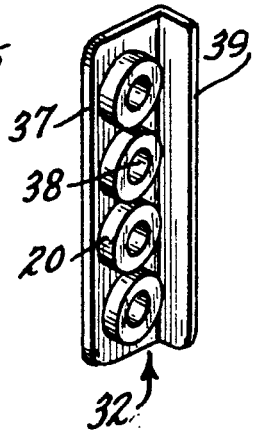
FIG. 10 is a perspective view of a floating type supplemental bracket which may be utilized with the wiring harness systems, both adjustable and non-adjustable, of the present invention.
Figure 8:
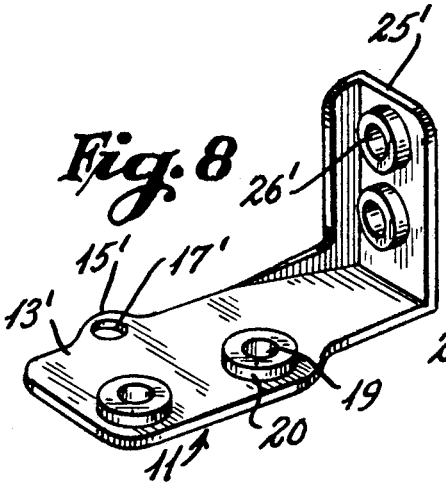
FIG. 8 is a perspective view of a second nonadjustable bracket utilized with the wiring harness system of the present invention as shown in FIG. 2.

In order to retain the spark plug wires in an orderly relationship between the distributor D and the first mounting brackets 10 or 10', either a third fixed mounting bracket 30 or a floating mounting bracket 32 may be utilized, or both, and which are shown in FIGS. 8 and 9, respectively. The fixed bracket 30 includes a base portion 33 having an opening 34 therethrough through which a mounting bolt may be selectively secured in order to secure the bracket to the intake manifold. The bracket 30 further includes a body portion 35 having a plurality of spaced openings 36 therethrough, through which a number of spark plug wires extend from the distributor to the first outer extensions of the brackets 10 and 10'. Therefore, the number of openings 36 in the fixed bracket are equal to the number of openings in the first vertical extensions 21 and 21' of the mounting brackets 10 and 10'. As with the other bracket members, grommets 20 may be inserted within the openings 36 and are of a size to frictionally engage the spark plug wires. Further, as with the spark plug wire openings in each of the first and second mounting brackets, the openings through the fixed mounting bracket are fully enclosed so that the spark plug wires may not be disengaged by vibration from the openings.

In some instances, instead of utilizing a fixed mounting bracket 30, a third floating mounting bracket 32 may be utilized to retain the spark plug wires in an orderly relationship between the distributor and the first mounting bracket 10 or 10'. In FIG. 9, the floating mounting bracket is shown as including a body portion 37 having a plurality of spaced openings 38 therethrough of a number equal to the number of openings 23 and 23' through the vertical extensions 21 and 21' of the brackets 10 and 10'. In addition, the floating bracket includes an elongated flange 39 which extends along the length of the body 37 for purposes of strengthening the bracket.

As previously discussed, the first and second mounting brackets 10 and 11 have base portions 12 and 13 which are longitudinally adjustable by constructing the base in two segments. With specific reference to FIGS. 4 and 5, bracket member 10 includes a base portion 12 having first and second sections 50 and 51. Section 50 is connected to the vertical extensions 21 and 22 and includes the openings 18 therethrough. The opening 16, however, is provided through section 51 which also incorporates the flange 14. Each section 50 and 51 includes a plurality of spaced adjustment openings 53 and 54, through which spaced fasteners 55 and 56 may be threaded so as to secure the base sections 50 and 51 relative to one another. By selectively horizontally adjusting the sections 50 to 51, the flange 14 and opening 16 may be selectively positioned at different spacings from the openings 18 through which the spark plug wires are carried. In this manner, it is possible to connect the bracket to the valve cover utilizing the existing valve cover bolts B and yet vary the spacing of the mounting bolts relative to the openings 18 through which the spark plug wires extend to the spark plugs.

Figure 5:
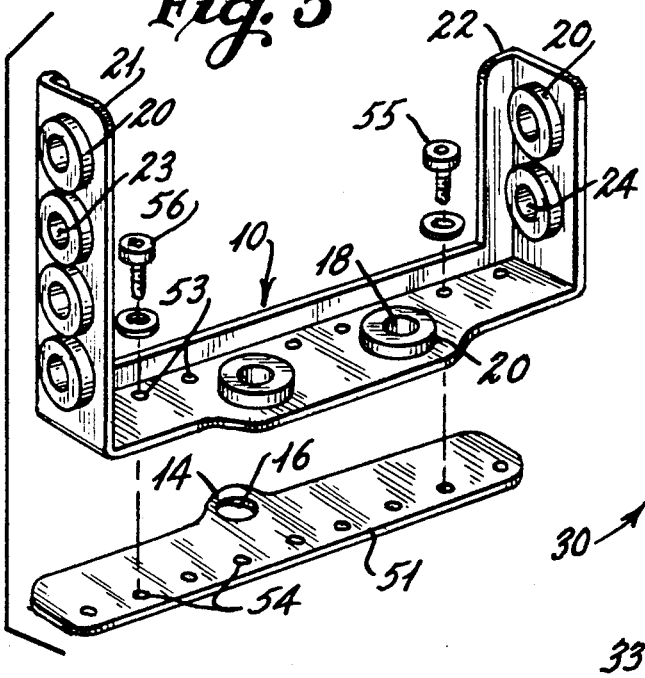
FIG. 5 is an assembly view of an adjustable spark plug wire mounting bracket of the embodiment of the wiring harness system of the present invention shown in FIG. 4.

With specific reference to FIG. 5, the second brackets 11 includes a base portion 13 including sections 60 and 61 having a plurality of adjustment openings 62 and 63 therethrough, respectively. The adjustment openings are selectively vertically aligned with respect to one another and the sections secured by fastening elements 64 and 65. As with the first mounting brackets, the second mounting brackets may be adjusted so that the opening 17, through which a valve cover bolt extends, may be selectively positioned relative to the openings 19, through which the spark plug wires extend.

It is preferred that the bracket members of the present invention be constructed of a metallic material which is coated to prevent corrosion. In use, once the brackets have been mounted to the engine as previously discussed, one end of the spark plug wires will be extended through the openings in each of the mounting brackets, after which the socket for mounting the spark plug wires to the spark plugs is attached to each wire and the wires connected to the spark plugs. As the openings through each of the mounting brackets are enclosed in each bracket member, the spark plug wires cannot be accidently dislodge and are therefore positively retained in spaced relationship with respect to one another and the engine block.

I claim:

1. A harness assembly for supporting wires extending between the distributor and each of a given number of spark plugs associated with an internal combustion engine of the type having a valve cover which is secured to the engine by a plurality of bolts, the assembly comprising, a first bracket member having a base portion and a first vertical extension, said base portion having an opening for selectively receiving one of the valve cover bolts therethrough, a first plurality of spaced openings through said first vertical extension through which the wires are supported in spaced relationship with respect to one another, and a second plurality of spaced openings in said base portion thereof through which a number of the wires extend to the spark plugs whereby said first bracket member is selectively secured to support the wires in spaced and orderly relationship relative to the engine.

2. The harness assembly of claim 1 including grommet means within each of said first and second openings, said grommet means defining an opening of a size to frictionally engage the wires extending therethrough.

3. The harness assembly of claim 1 in which said base portion of said bracket member includes first and second sections, adjusting means for selectively securing said first section in relative horizontal relationship to said second section.

4. The harness assembly of claim 3 in which said first vertical extension extends from said first section of said base portion and said second plurality of openings extend through said first section, and a flange extending from said second section of said base portion, said opening for selectively receiving one of the valve cover bolts being through said flange, whereby said flange may be horizontally shifted relative to said plurality of first and second openings.

5. The harness assembly of claim 4 in which said adjusting means includes a plurality of equally spaced holes in each of said first and second sections, and locking means selectively extendable through pairs of spaced and aligned holes to thereby secure said first and second sections in adjusted relationship with respect to one another.

6. The harness assembly of claim 5 including a second vertical extension extending from said first base portion, said first and second vertical extensions being spaced on opposite sides of said second openings in said first base section, and third openings in spaced relationship through said second vertical extension.

7. The harness assembly of claim 6 including four first openings in said first vertical extension, two spaced openings in said first section of said base portion, and two third openings in said second extension whereby two wires extend through said first and second openings and two wires extend through said first and third openings.

8. The harness assembly of claim 6 including a second bracket member having a base portion and a third vertical extension, additional openings in spaced relationship through said third vertical extension of said second bracket member, the same number of additional openings in said base portion of said second bracket member, said base portion including a flange extending outwardly therefrom and having an opening therethrough through which another of the valve cover bolts is selectively extended.

9. The harness assembly of claim 8 in which said base portion of said second bracket member includes first and second sections, and second adjusting means for selectively adjusting said first and second sections horizontally relative to one another.

10. The harness assembly of claim 9 in which said flange of said second bracket member extends form said second section and said additional openings in said base extend through said first section.

11. The harness assembly of claim 10 including a third bracket member having a number of openings therethrough of a number equal to the number of openings in said first vertical extension of said first bracket member, the wires being extendable through said openings in said third bracket member intermediate the distributor and said first vertical extension.

12. The harness assembly of claim 11 in which said third bracket member includes a base portion, and means for mounting said base portion thereof to the engine.

13. The harness assembly of claim 1 in which said opening through which one of the valve cover bolts extends is provided through a flange extending outwardly from said base portion.

14. The harness assembly of claim 13 including a second vertical extension extending from said base portion, said first and second vertical extensions being spaced on opposite sides of said second openings in said base portion, and a third plurality of openings in vertically spaced relationship through said second vertical extension.

15. The harness assembly of claim 13 including a second bracket member having a base portion and a third vertical extension, additional openings in spaced relationship through said third vertical extension of said second bracket member and the same number of additional openings in said base portion of said second bracket member, said base portion including a flange extending outwardly therefrom and having an opening therethrough through which another of the valve cover bolts is selectively extended.

16. The harness assembly of claim 15 including a third bracket member having a number of openings therethrough of a number equal to the number of openings in said first vertical extension of said first bracket member, the wires being extendable through said openings in said third bracket member intermediate the distributor and said first vertical extension of said first bracket member.

17. The harness assembly of claim 16 in which said third bracket member includes a base portion, and means for mounting said base portion thereof to the engine.

18. A harness assembly for supporting wires extending between the distributor and each of a given number of spark plugs associated with an internal combustion engine of the type having a valve cover which is secured to the engine by a plurality of bolts, the assembly comprising, first and second bracket members, said first bracket member having first and second spaced vertical extensions extending from a base portion, said second bracket member having a third extension extending from a base portion, each of said base portions having means for mounting said first and second brackets relative to the valve cover of the engine, a first number of spaced openings through said first vertical extension through which the wires are supported in spaced relationship with respect to one another, a second number of spaced openings in said base portion of said first bracket member through which a number of wires equal to said second number extend to the spark plugs, a third number of spaced openings through each of said second and third vertical extensions and said base portion of said second bracket member through which a number of wires equal to said third number extend toward the spark plugs whereby said first and second bracket members are selectively secured to support the wires in spaced and orderly relationship relative to the engine.

19. The harness assembly of claim 18 in which said first and second base portions include first and second sections, adjusting means for selectively securing said first sections relative to said second sections.

20. The harness assembly of claim 18 including a third bracket member having a number of openings therethrough of a number equal to the number of openings in said first vertical extension of said first bracket member, the wires being extendable through said openings in said third bracket member intermediate the distributor and said first vertical extension of said first bracket member.

* * * * *